US006119388A

United States Patent [19]

Jones et al.

[11] Patent Number: 6,119,388

[45] **Date of Patent: *Sep. 19, 2000**

[54] FIREARM CASING DEVICE

[75] Inventors: Brent Jones, Greer; Robert Lawrence Parker, Clarkshill; Phillip Durham, Greer, all of S.C.

[73] Assignee: Innovative Sports, Inc., Greer, S.C.

[ * ] Notice: This patent is subject to a terminal disclaimer.

[21] Appl. No.: 09/082,591

[22] Filed: May 21, 1998

[51] Int. Cl.[7] ..... F41A 35/04

[52] U.S. Cl. ..... 42/96

[58] Field of Search ..... 42/96, 74; 206/317; 33/244

[56] References Cited

U.S. PATENT DOCUMENTS

| | | | |
|---|---|---|---|
| Re. 32,752 | 9/1988 | Kiang | 42/96 |
| 2,364,340 | 12/1944 | Bogg, Jr. | 42/106 |
| 2,599,689 | 6/1952 | Brelsford | 42/96 |
| 2,872,960 | 2/1959 | Kolpin | 209/317 |
| 3,239,114 | 3/1966 | Norsworthy | 206/317 |
| 3,437,247 | 4/1969 | Gantress | 206/317 |
| 3,574,965 | 4/1971 | Seiger | 42/96 |
| 3,665,990 | 5/1972 | Hefner, Jr. | 42/74 |
| 3,701,371 | 10/1972 | Stackhouse | 206/317 |
| 3,720,013 | 3/1973 | McDonald | 42/106 |
| 3,865,166 | 2/1975 | Pedro | 206/317 |
| 3,977,113 | 8/1976 | Howell | 42/100 |
| 4,280,644 | 7/1981 | Shindelka | 224/149 |
| 4,328,633 | 5/1982 | Pachmayr et al. | 42/74 |
| 4,433,500 | 2/1984 | Kunevicius | 42/96 |
| 4,644,987 | 2/1987 | Kiang | 42/96 |
| 4,649,973 | 3/1987 | Uchin | 206/316.2 |
| 4,754,498 | 7/1988 | Stinemates | 2/17 |
| 4,756,456 | 7/1988 | Schauer | 224/150 |
| 4,858,361 | 8/1989 | White | 42/96 |
| 4,860,479 | 8/1989 | Easter | 42/96 |
| 5,016,793 | 5/1991 | Derkatz | 224/627 |
| 5,642,585 | 7/1997 | Watley | 42/96 |
| 5,661,920 | 9/1997 | Evans | 42/96 |
| 5,678,344 | 10/1997 | Jones et al. | 42/96 |

FOREIGN PATENT DOCUMENTS

| | | |
|---|---|---|
| 235290 | 9/1910 | Germany . |

*Primary Examiner*—Charles T. Jordan
*Assistant Examiner*—Denise J Buckley
*Attorney, Agent, or Firm*—Dority & Manning, P.A.

[57] ABSTRACT

A casing for protecting firearms from the elements while allowing the user to access firearm sight and trigger. Although the firearm is at all times fully enclosed in the cover, the firearm may be aimed and discharged without having to remove the firearm from its protective casing.

14 Claims, 2 Drawing Sheets

FIREARM CASING DEVICE

BACKGROUND OF THE INVENTION

The present invention is generally related to the art of firearm casings. More particularly, this invention is related to a protective cover for a firearm which permits the firearm to be sighted and discharged while remaining protected from the elements.

There are various apparatuses which can be employed to encase a firearm. These implements are generally unsatisfactory as they do not permit use of a firearm sight while the firearm is enclosed in the casing. Various gun casings and covers and their method of construction are known and found in the prior art.

U.S. Pat. No. 3,865,166 to Pedro shows a molded plastic case for protecting firearms.

U.S. Pat. No. 3,437,247 to Gantress discloses a cover for protecting a rifle from the elements while permitting the firearm, enclosed in the cover, to be fired. However, Gantress's apparatus does not permit use of a sight while the rifle is enclosed in the cover.

U.S. Pat. No. 4,756,456 to Schauer shows a gun case for protecting a rifle from the elements while being carried in the field. Schauer's apparatus requires the firearm to be removed from the case before discharging the rifle.

U.S. Pat. No. 3,701,371 to Stackhouse shows a storable gun case small enough to fit into a person's shirt pocket. The Stackhouse case has openings permitting the triggering of a gun while in the case, however, it does not permit the use of the sight while so encased.

The prior art of the inventor, U.S. Pat. No. 5,678,344 to Jones, et al., the disclosure of which is incorporated herein by reference, discloses a cover for protecting a rifle from the elements allowing both the firing of the gun and the use of the sight while enclosed in the cover.

However, while devices such as those described above provide protection for firearms, there are still problems associated with the use of firearms which are not addressed. For example, none of the devices described above provides for the protection of the sight from the elements, i.e. rain, snow, or direct sun, while the sight is in use. Thus, it is seen that there is still room for improvement in the art.

SUMMARY OF THE INVENTION

It is thus an object of the present invention to provide a means for protecting a firearm from the elements while accessing the sight in aiming and discharging the firearm.

It is a further object of the invention to provide such protection adaptable to various kinds and sizes of firearm telescopic sights.

It is yet another object of the invention to provide such protection which is easily portable.

It is yet a further object of the invention to protect the sight from the elements while accessing the sight.

It is an additional object of the invention to provide sighting means on the gun cover to assist in aiming the gun accurately.

These and other objects of this invention are provided by a casing for protecting a firearm from the elements, comprising: a cover for enclosing a firearm protecting it from the elements; a sight aperture defined by said cover for allowing a sight to project from said cover; and a flap defined by said cover and folded over said sight aperture, wherein said flap comprises a semi-rigid member.

DETAILED DESCRIPTION

In accordance with this invention, it has been found that a firearm cover can be provided to enclose and protect a firearm from the elements while enabling the user to access the firearm sight, trigger and carrying strap. The protective cover, which is preferably in the shape of a firearm, maintains the rifle in a state of readiness and permits the rifle to be discharged while enclosed in the cover. The cover may, however, be in any shape which could accommodate a firearm. A flap portion of the cover is constructed of a semi-rigid material such that when in an open position, the flap forms a roof-like structure over the gun sight to protect it from the elements. The cover may also be provided with a sighting bead incorporated at the end of the barrel portion of the protective cover to aid in aiming.

Figure 1:
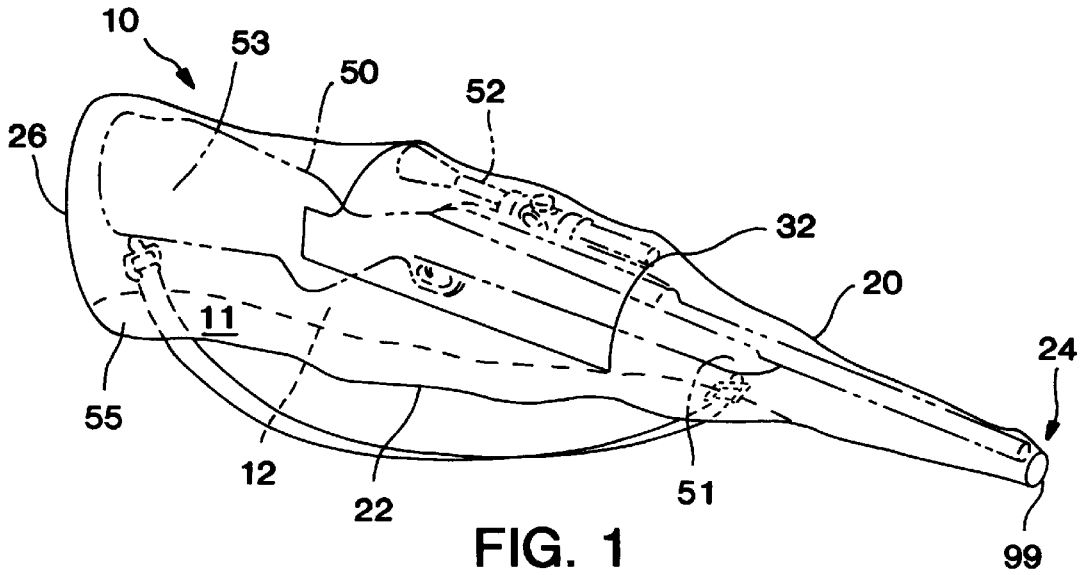
FIG. 1 is a side perspective view illustrating a firearm, in phantom, encased within the cover.
Figure 2:
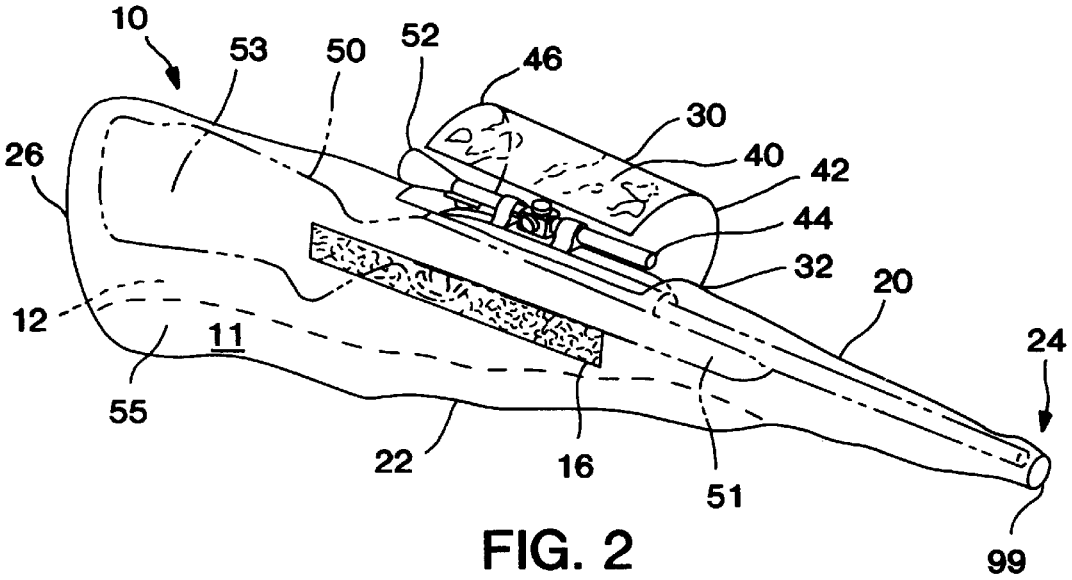
FIG. 2 is a side perspective view of firearm cover illustrating accessibility of the sight and the flap providing protection for the sight during use of the firearm.

FIGS. 1 and 2 illustrate cover 10, generally, having opposing panels 11 and 12. Cover 10 may be fabricated from a suitable water-resistant material, which is preferably camouflaged. Panels 11 and 12 may be fabricated from any number of water-impermeable materials such as GORTEX® fabric, vinyl or sturdy canvas treated with a water repellant finish. A firearm 50 is enclosed in cover 10. The firearm 50 includes a stock 51 having a butt 53. A sight 52 is mounted upon the firearm 50. Cover 10 has upper longitudinal edge 20 having sight opening 32 formed therein for accessing sight 52. Cover 10 also has lower longitudinal edge 22 which is selectively sealed along portions of panels 11 and 12 to form access opening 55 which permits insertion of a firearm. Once a firearm is inserted into cover 10, the unsealed portions of lower longitudinal edge 22 permit access and use of the rifle's trigger and attached carrying strap, if any.

Contiguous with both upper longitudinal edge 20 and lower longitudinal edge 22 is stock end 26 which may be formed by joining the respective edges of panels 11 and 12. Terminal aperture 24, opposite stock end 26, permits a firearm to be discharged while encased in cover 10. Terminal aperture 24 may be selectively closed around the barrel of firearm 50 by a fourth fastener 99, such as a hook and loop fastener.

FIG. 2 shows extension of sight 52 from sight aperture 32. An extended portion of panel 12, or a third panel which may be detachable, forms flap 30. FIG. 2 illustrates flap 30 in an open position. Flap 30 comprises a semi-rigid member 40 enclosed in the water resistant material of the cover 10 and formed preferably in an arching configuration over the sight aperture. The semi-rigid member 40 may comprise a flexible plastic or other suitable material. When the flap 30 is in an open position, the semi-rigid member 40 is positioned over sight 52 in an arching manner to provide protection for the sight from the elements, or from the glare of the sun, thus providing the user an enhanced line of sight. In this way, flap 30 forms a roof-like structure over sight 52 when in an open position. In addition, the flap 30 comprises a forward edge 42 and a back edge 46 which extend to cover the sight. The forward edge 42 of the flap 30 extends beyond the sight front 44 thus protecting the sight from becoming obscured by elements such as rain, snow or debris that might fall from the surrounding environment. The forward edge 42 may also provide some shading over the sight in times of bright sunlight. The flap 30 is fastened to cover 10 by fastener 16, which is preferably a hook and loop fastener such as Velcro®, when in a closed position. Other fastening methods such as zippers, buttons and snaps may be employed.

Figure 3:
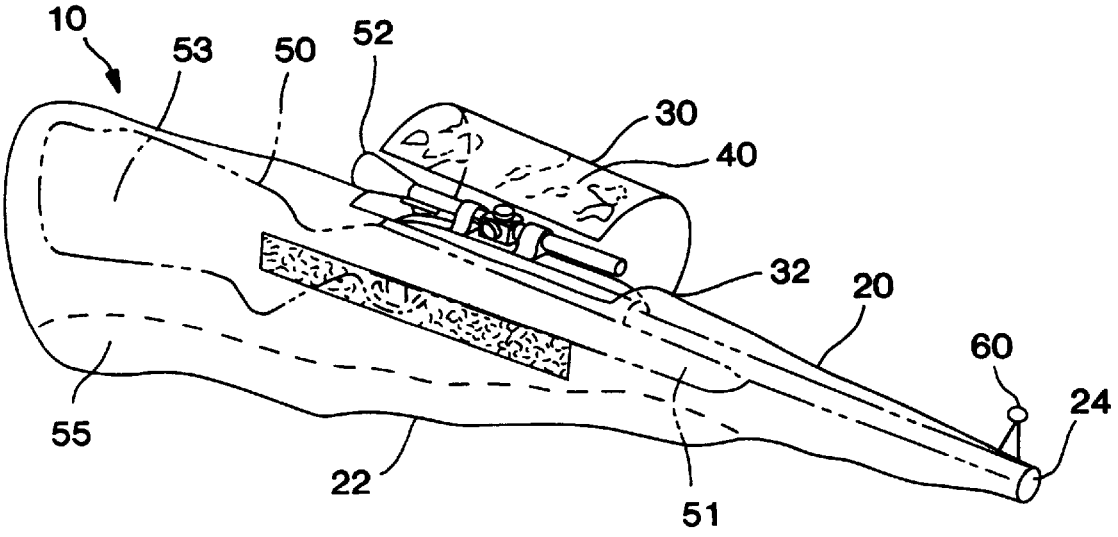
FIG. 3 is a side perspective view of the firearm cover illustrating position of the sighting bead on the cover.

In FIG. 3, cover 10 may likewise be provided with a sighting bead 60 at the portion of the cover 10 at the terminal aperture 24. This sighting bead 60 is positioned at the terminal aperture 24 to enhance the user's aim and may comprise a metal, plastic, a combination of metal and plastic, or any suitable material. The sighting bead 60 may be used with guns equipped with sights and, more particularly, with guns with no sights or with removable sights. Magnets may also be used in conjunction with the cover 10 in order to accommodate, for example, a fiber optic sighting device on the market which uses magnets to affix to the gun.

While not particularly shown in the drawings, it is envisioned that cover may contain pockets and elastic bands to hold small objects such as cartridges and bullets. Also, cover 10 may have a strap to permit firearm 50 enclosed in cover 10 to be carried in the field. Furthermore, cover 10 may be easily folded and carried in the field in an accompanying case (not shown) preferable made of the same water resistant material, thus making the cover accessible and storable.

It is thus seen that in accordance with this invention a casing apparatus is provided which permits the enclosed firearm to be aimed utilizing a sight protected by a flap, and discharged. As variations will become apparent to those of skill in the art from reading of the above description, such variations are embodied within the spirit and scope of the invention as defined by the following appended claims.

What is claimed is:

1. An apparatus for protecting a firearm having sight and a stock with a butt, comprising:

(a) a cover for enclosing a firearm, wherein said cover is configured for overlapping the stock, including the butt, of the firearm;

(b) a sight aperture defined by said cover and configured for allowing the sight to project from said cover; and (c) a flap defined by said cover and configured for folding over said sight aperture, wherein said flap comprises a semi-rigid member.

2. The apparatus of claim 1 wherein said cover comprises a water resistant material.

3. The apparatus of claim 2 wherein said material is camouflaged.

4. The apparatus of claim 2 wherein said material is a water impermeable-material.

5. The apparatus of claim 1 wherein said semi-rigid material is a flexible plastic.

6. An apparatus for protecting a firearm, comprising:

(a) a cover for enclosing a firearm protecting it from the elements;

(b) a sight aperture defined by said cover for allowing a sight to project from said cover;

(c) a flap defined by said cover and folded over said sight aperture, wherein said flap comprises a semi-rigid member; and (d) a sighting bead attached to said cover.

7. The apparatus of claim 5 wherein said cover comprises a water resistant material.

8. The apparatus of claim 5 wherein said semi-rigid material is a flexible plastic.

9. The apparatus of claim 5 wherein said sighting bead is a metal structure.

10. A casing for protecting a firearm having a sight from the elements, comprising:

(a) a fabric cover following the contour of the firearm, said cover having opposing panels;

(b) said cover having an upper longitudinal edge, said upper longitudinal edge having a sight aperture formed therein for accessing the sight;

(c) said upper longitudinal edge having a flap for covering said sight aperture, said flap comprising a semi-rigid material;

(d) said cover having a lower longitudinal edge, said lower longitudinal edge having an access opening formed therein for inserting and accessing the firearm;

(e) said cover having a stock end contiguous with both said upper longitudinal edge and said lower longitudinal edge;

(f) said cover having a terminal aperture opposite said stock end; and (g) said cover having a sighting bead at said terminal aperture.

11. A casing for protecting a firearm from the elements, comprising:

(a) an elongated cover in the shape of a firearm;

(b) said cover having opposing panels, said panels forming an upper longitudinal edge, a lower longitudinal edge, a stock end and a terminal aperture;

(c) said lower longitudinal edge having an access opening permitting insertion of a firearm and access to a firearm trigger;

(d) said access opening having a first fastener for closing said access opening;

(e) said upper longitudinal edge having a sight aperture defined by said panels for accessing a sight;

(f) said upper longitudinal edge defining a flap for covering said access opening;

(g) said sight aperture having a second fastener for closing said flap over said sight aperture; and (h) said terminal aperture comprising a sighting bead and having a third fastener for closing said terminal aperture.

12. An apparatus for protecting a firearm having a sight and a stock with a butt, comprising:

(a) a cover configured for enclosing the firearm and protecting the firearm from the elements;

(b) a sight aperture defined by said cover and configured for allowing the sight to project from said cover; and (c) a flap defined by said cover and configured for folding over said sight aperture, wherein said flap comprises a semi-rigid member that is fastened to said cover when in a closed position.

13. An apparatus for protecting a firearm having a sight and a stock with a butt, comprising:

a) a cover for enclosing a firearm, wherein said cover is configured for overlapping the stock, including the butt, of the firearm;

b) a sight aperture defined by said cover and configured for allowing the sight to project from said cover; and c) a flap defined by said cover and configured for folding over said sight aperture;

wherein said flap comprises a semi-rigid member and forms a structure disposed over the sight in an arching manner when in an open position.

14. An apparatus for protecting a firearm, comprising:

a) a cover for enclosing a firearm protecting it from the elements;

b) a sight aperture defined by said cover for allowing a sight to project from said cover;

c) a flap defined by said cover and folded over said sight aperture, wherein said flap comprises a semi-rigid member; and d) a sighting bead attached to said cover;

wherein said flap forms a structure disposed over the sight in an arching manner when in an open position and is fastened to said cover when in a closed position.

* * * * *

UNITED STATES PATENT AND TRADEMARK OFFICE

CERTIFICATE OF CORRECTION

PATENT NO. : 6,119,388
DATED : September 19, 2000
INVENTOR(S) : Brent Jones, Robert Lawrence Parker, and Phillip Durham It is certified that error appears in the above-identified patent and that said Letters Patent is hereby corrected as shown below:

Claims,

Claim 7,

Reads as follows: The apparatus of claim 5 wherein said cover comprises a water resistant material.

Please correct Claim 7 to read as such: The apparatus of claim 6 wherein said cover comprises a water resistant material.

Claim 8,

Reads as follows: The apparatus of claim 5 wherein said semi-rigid material is a flexible plastic.

Please correct Claim 8 to read as such: The apparatus of claim 6 wherein said semi-rigid material is a flexible plastic.

Claim 9,

Reads as follows: The apparatus of claim 5 wherein said sighting bead is a metal structure.

Please correct Claim 9 to read as such: The apparatus of claim 6 wherein said sighting bead is a metal structure.

Signed and Sealed this

Twenty-third Day of October, 2001

*Attest:*

Nicholas P. Godici

NICHOLAS P. GODICI

*Attesting Officer*

*Acting Director of the United States Patent and Trademark Office*